US006815893B2

(12) United States Patent
Kakisaka et al.

(10) Patent No.: US 6,815,893 B2
(45) Date of Patent: Nov. 9, 2004

(54) METAL HALIDE LAMP HAVING A LONG LIFESPAN

(75) Inventors: Shunsuke Kakisaka, Ibaraki (JP); Kazuo Takeda, Sakai (JP); Takashi Maniwa, Takatsuki (JP); Yoshiharu Nishiura, Otsu (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 61 days.

(21) Appl. No.: 10/282,468

(22) Filed: Oct. 29, 2002

(65) Prior Publication Data

US 2003/0080681 A1 May 1, 2003

(30) Foreign Application Priority Data

Oct. 30, 2001 (JP) ..... 2001-332937

(51) Int. Cl.[7] ..... H01J 61/18; H01J 61/33
(52) U.S. Cl. ..... 313/634; 313/638; 313/317
(58) Field of Search ..... 313/634, 638, 313/643, 573, 493, 317, 623, 624

(56) References Cited

U.S. PATENT DOCUMENTS 4,503,356 A * 3/1985 Kobayashi et al. ..... 313/634
2002/0179859 A1 * 12/2002 Takeji et al. ..... 250/503.1
2002/0185974 A1 * 12/2002 Nakano et al. ..... 313/623

FOREIGN PATENT DOCUMENTS

| | | | |
|---|---|---|---|
| JP | 08-273595 | 10/1996 | |
| JP | 10-214595 | 8/1998 | |
| JP | 11-073921 | 3/1999 | |
| JP | 2000-048769 | 2/2000 | |
| JP | 2002164019 A * | 6/2002 | ..... H01J/61/88 |
| WO | WO 01/71768 | 3/2001 | |

* cited by examiner

*Primary Examiner*—Ashok Patel
*Assistant Examiner*—Karabi Guharay

(57) ABSTRACT

The present invention provides a metal halide lamp having a ceramic arc tube vessel that includes a discharge arc tube member and thin tube members, the discharge arc tube member including taper parts and a main tube part in the middle in a longitudinal direction, the taper parts and the main tube part having a larger outside diameter than an outside diameter of ends of the discharge arc tube in a longitudinal direction, and the thin tube members each being fit to the respective ends of the discharge arc tube, where a minimum curvature radius R is set to be 0.3 mm or more at each transitional area of an external surface between each taper part and a corresponding end of the discharge arc tube.

12 Claims, 8 Drawing Sheets

FIG.4

| | | | |
|---|---|---|---|
| MATERIAL | DISCHARGE ARC TUBE MEMBER21 | ALUMINA CERAMIC | |
| | THIN TUBE MEMBER211,218 | ALUMINA CERAMIC | |
| | FEEDING MEMBER 202,219 | $Al_2O_3$-Mo CONDUCTIVE CERMET | |
| | EXTERNAL LEAD WIRE201,209 | NIOBIUM | |
| | OUTER GLASS BULB | HARD GLASS | |
| SIZE | THIN TUBE MEMBER211,218 | OUTSIDE DIAMETER OF TUBE | 3.3mm |
| | | INSIDE DIAMETER OF TUBE | 1.0mm |
| | | LENGTH | 17.0mm |
| | MAIN TUBE PART215 | OUTSIDE DIAMETER OF TUBE | 12.0mm |
| | | INSIDE DIAMETER OF TUBE | 10.7mm |
| | | LENGTH | 14.6mm |
| | DISCHARGE ARC TUBE-END PART207,212 | OUTSIDE DIAMETER OF TUBE | 6.4mm |
| | | INSIDE DIAMETER OF TUBE | 3.2mm |
| | | LENGTH | 3.0mm |
| | TUNGSTEN ELECTRODE204,212 | OUTSIDE DIAMETER OF TUBE | 0.5mm |
| | | LENGTH | 16.5mm |
| | | DISTANCE BETWEEN ELECTRODES | 10.0mm |
| | FEEDING MEMBER202,219 | OUTSIDE DIAMETER | 0.9mm |
| | | LENGTH | 10.0mm |
| | SEAL LENGTH OF FRIT | | 3.4mm |

FIG.5

| | | |
|---|---|---|
| INITIAL CHARACTERISTIC | RAY BUNDLE OF LAMP | 13,800 lm |
| | LAMP EFFICIENCY | 92 lm/W |
| | COLOR TEMPERATURE | 4,280 K |
| | AVERAGE COLOR RENDERING INDEX Ra | 90 |
| LIFESPAN OF LAMP (IN HOURS) | | 9,000 HRS OR MORE |

FIG.7

| | | | |
|---|---|---|---|
| MATERIAL | ARC TUBE VESSEL 30 | ALUMINA CERAMIC | |
| | FEEDING MEMBER | $Al_2O_3$-Mo CONDUCTIVE CERMET | |
| | EXTERNAL LEAD WIRE | NIOBIUM | |
| SIZE | THIN TUBE PART311,315 | OUTSIDE DIAMETER OF TUBE | 3.9mm |
| | | INSIDE DIAMETER OF TUBE | 1.3mm |
| | | LENGTH | 19.8mm |
| | DISCHARGE ARC TUBE MEMBER31 | LENGTH | 33.7mm |
| | MAIN TUBE PART313 | OUTSIDE DIAMETER OF TUBE | 19.2mm |
| | | INSIDE DIAMETER OF TUBE | 17.0mm |
| | | LENGTH | 33.7mm |
| | TUNGSTEN ELECTRODE304,314 | OUTSIDE DIAMETER OF TUBE | 0.7mm |
| | | LENGTH | 22.3mm |
| | | DISTANCE BETWEEN ELECTRODES | 22.5mm |
| | FEEDING MEMBER302,316 | OUTSIDE DIAMETER | 1.2mm |
| | | LENGTH | 10.0mm |
| | SEAL LENGTH OF FRIT | | 4.5mm |

FIG.8

| | | |
|---|---|---|
| INITIAL CHARACTERISTIC | RAY BUNDLE OF LAMP | 36,600 lm |
| | LAMP EFFICIENCY | 1221 lm/W |
| | COLOR TEMPERATURE | 4,270 K |
| | AVERAGE COLOR RENDERING INDEX Ra | 65 |
| LIFESPAN OF LAMP (IN HOURS) | | 12,000 HOURS OR MORE |

METAL HALIDE LAMP HAVING A LONG LIFESPAN

CROSS-REFERENCE TO RELATED APPLICATIONS

This application is based on application No. 2001-332937 filed in Japan, the contents of which are hereby incorporated by reference.

BACKGROUND OF THE INVENTION

1. Field of the Invention

The present invention relates to a tube structure of a metal halide lamp having a ceramic arc tube made of such material as alumina ceramic.

2. Related Art

A metal halide lamp is a high intensity discharge lamp in which a metal halide is enclosed in its arc tube. For conventional metal halide lamps, silica is used as a material for the arc tube. Recently, however, ceramic is getting attentions to replace the silica, since the silica-made arc tube has not yielded enough strength against the high temperature and high pressure resulting from the light emission.

Specifically, the ceramic material has 1,200° C. heat resistance, as opposed to that of the silica material which is 1,000° C. The ceramic material also has better mechanical strength compared to the silica material, which has led to a vigorous development attempts for an arc tube that uses ceramic materials.

However, in order to realize a metal halide lamp with a high luminous efficacy and a better color-rendering characteristic, it is necessary to apply a greater power to the metal halide lamp. In such a case, an arrangement such as downsizing the arc tube becomes necessary in order to raise the temperature in an attempt to increase the vapor pressure of a metal halide. This increases a possibility of the arc tube being broken even using ceramic material for the arc tube.

Tests have been conducted as for the quality of the commercially available metal halide lamp made of ceramic. The results indicate that (1) most breakable type of metal halide lamp is one which has a great power consumption, in particular 70 W or more, (2) occurrence of break is more frequent for higher voltage of the power source than the normal power rating, and (3) a larger number of metal halide lamps are broken by longer aging time.

Specific data for (3) shows that only a few percent of the total metal halide lamps examined are broken before the aging hours exceed 6,000 hours. Note that this tendency of quality applies for all types of arc-tube structure, whether it is an integrally-molded arc tube, or an arc tube in which a plurality of members have been fit by shrink fit.

SUMMARY OF THE INVENTION

The object of the present invention, in view of the above-described problems, is to provide a metal halide lamp equipped with a ceramic arc tube, which has a high luminous efficacy and a color-rendering characteristic, and is hard to break.

In order to achieve the above object, a metal halide lamp relating to the present invention is characterized by including a ceramic arc tube vessel which has a central tube member and two thin tube members, the central tube member having a larger outside diameter in a middle part than in two ends in a longitudinal direction, and one of the thin tube members being inserted to one of the two ends, and the other thin tube member being inserted to the other end, where the central tube member, on an external surface, has two transitional areas which each have a minimum curvature radius of 0.3 mm or more, each transitional area being between the middle part and a corresponding one of the ends. Here, a power consumption of the metal halide lamp may be in a range of 70 W to 400 W inclusive.

The above construction prevents microcracks that would occur at the ends of the central tube member due to the lamp aging lighting, which is especially effective for a high-wattage metal halide lamps, which uses an arc tube vessel which includes the ceramic central tube member and two ceramic thin tube members. According to the construction, a break at such ends is assuredly prevented. This realizes a metal halide lamp made of alumina ceramic which is high-wattage and is of high quality in terms of lifespan as a lamp.

Note that the microcrack here means a crack of about 1/1000 mm that is impossible to be observed by the naked eyes.

Further, the arc tube vessel may be made of alumina ceramic.

According to the above construction, light dispersion through the alumina particles will attain a good light distribution characteristic.

In addition, a metal halide lamp relating to the present invention is characterized by including an arc tube vessel made of ceramic, the arc tube vessel having a larger outside diameter in a middle part than in two ends in a longitudinal direction, where the arc tube vessel, on an external surface, has two transitional areas which each have a minimum curvature radius of 0.3 mm or more, each transitional area being between the middle part and a corresponding one of the ends. For this type of metal halide lamp, the maximum value for the minimum curvature radius at each of the transitional areas is preferably 7 mm. According to the above construction, the object of the present invention is achieved on the metal halide lamp including an arc tube vessel that is integrally molded. Here, a power consumption of the metal halide lamp may be in a range of 70 W to 400 W inclusive.

Here, the integrally molded arc tube vessel may be also made of alumina ceramic. This construction enables to realize a good distribution characteristic for an integrally molded arc tube vessel.

In addition, a more concrete form of a metal halide lamp relating to the present invention may be a metal halide lamp including a ceramic arc tube vessel that has a central tube member and two thin tube members, one of the thin tube members being inserted to one of two ends of the central tube member, and the other thin tube member being inserted to the other end, where the central tube member is made by integrally-molding thereon the two ends thereof which each have a cylindrical-shape, a central part which has a larger diameter than a diameter of the two ends, and two taper parts which are each shaped substantially as a truncated cone, one of the taper parts connecting one of the two ends to a corresponding one of two end portions of the central part, and the other taper part connecting the other end to the other end portion of the central part, and the central tube member, on an external surface, has two transitional areas which each have a minimum curvature radius of 0.3 mm or more, each transitional area being between one of the ends of the central tube member and a corresponding taper part.

In addition, a metal halide lamp that has an integrally molded arc tube vessel may be realized by a metal halide lamp including an arc tube vessel made of ceramic, the arc tube vessel is formed by integrally-molding two thin tube parts which each are in a cylindrical-shape, a central part which has a larger diameter than the thin tube parts, and two taper parts which are each shaped substantially as a truncated cone, one of the taper parts connecting one of the thin tube parts with one of two ends of the central part, and the other taper part connecting the other thin tube part with the other end of the central part, where the arc tube vessel, on an external surface, has two transitional areas each have a minimum curvature radius of 0.3 mm or more, each transitional area being between one of the thin tube parts and a corresponding taper part.

According to the above construction enables the effect that the present invention tries to achieve.

BRIEF DESCRIPTION OF THE DRAWINGS

These and other objects, advantages and features of the invention will become apparent from the following description thereof taken in conjunction with the accompanying drawings that illustrate a specific embodiment of the invention. In the drawings:

FIG. 4 is a table showing materials and sizes for the metal halide lamp 1 relating to the first embodiment;

FIG. 5 is a table showing an initial characteristic and a lifespan for the metal halide lamp 1 of the first embodiment, which has been discovered in the tests;

FIG. 7 is a diagram showing materials and sizes for the metal halide lamp 3 relating to the second embodiment; and FIG. 8 is a diagram showing an initial characteristic and a lifespan for the metal halide lamp 3 relating to the second embodiment, which has been discovered in the tests.

DESCRIPTION OF THE PREFERRED EMBODIMENTS

The following describes embodiments of a metal halide lamp relating to the present invention, with reference to the drawings.

First Embodiment

Figure 1:
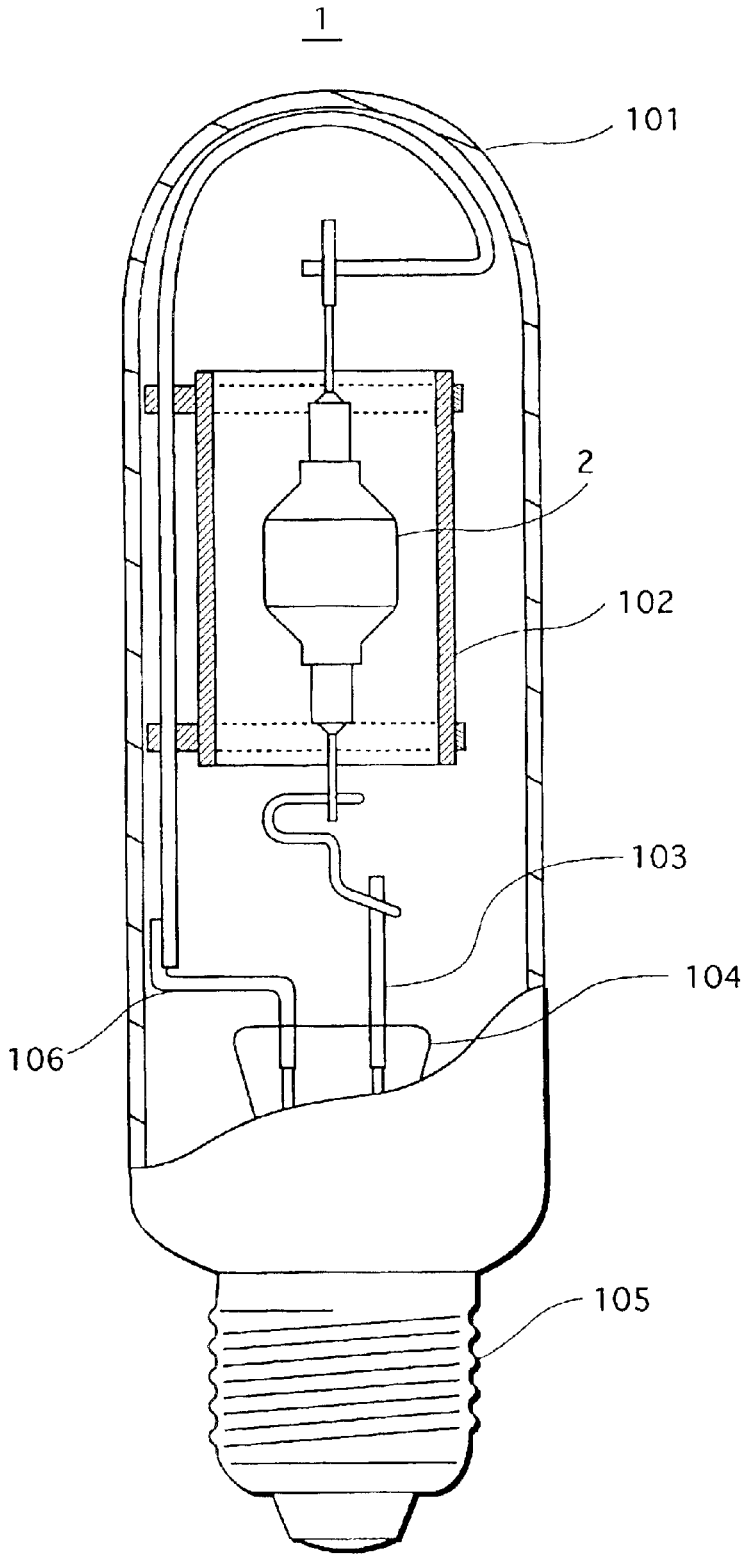
FIG. 1 is a diagram showing a structure of a metal halide lamp relating to the first embodiment, which is partly broken to show the internal structure of the lamp.

FIG. 1 is a diagram showing a structure of a metal halide lamp (power consumption of 150 W, and a color temperature of 4,300K) relating to the first embodiment. In FIG. 1, the metal halide lamp is partly broken to show the internal structure of the lamp. As FIG. 1 shows, the metal halide lamp 1 has a structure of having an outer glass bulb 101 attached to a mogul screw base 105. Inside the outer glass bulb 101, an arc tube 2 is held at one end by a lead-in wire 103, and the other end by a lead-in wire 106.

Both of the lead-in wires 103 and 106 come from a stem tube 104. A silica shielded tube 102 surrounds the arc tube 2. This is for protecting the outer glass bulb 101 from breaking, as a result of an explosion of the arc tube 2. Further, 40–60 kPa of nitrogen is enclosed inside the outer glass bulb 101. This is for, when there is a leak from the arc tube, insulating the lead-in wires 103, and 106, and the like, in order to prevent discharge outside the arc tube 2. The outer glass bulb also helps the arc tube being kept hot, and prevents oxidation of the lead line.

Figure 2:
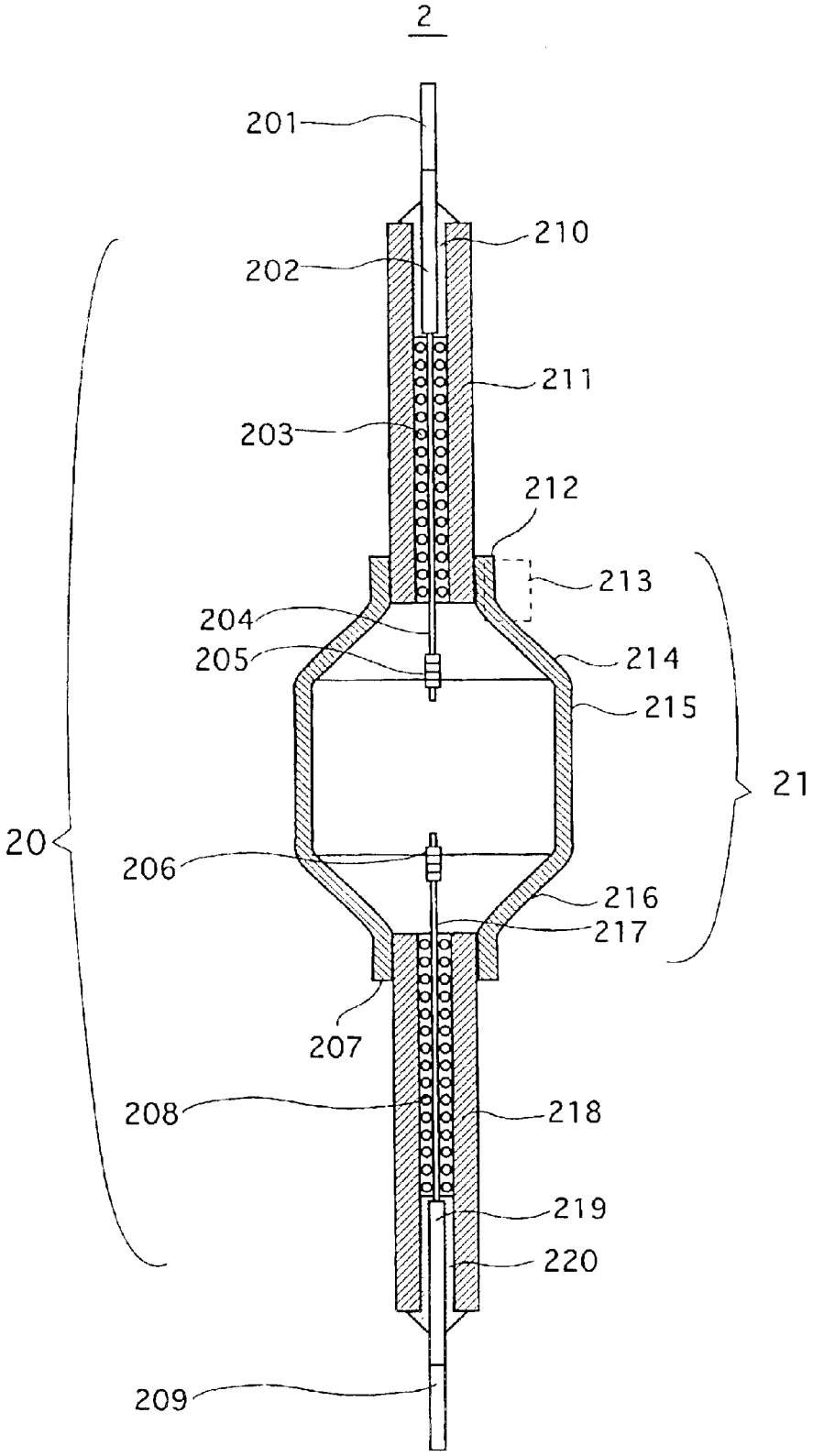
FIG. 2 is a sectional diagram showing a structure of the arc tube 2; the sectional view is taken at a plane including a revolution axis of the arc tube 2.

FIG. 2 is a sectional diagram showing a structure of the arc tube 2. The arc tube vessel 20 includes a discharge arc tube member 21, whose one end is fit to a thin tube member 211. The other end of the discharge arc tube member 21 is fit to a thin tube member 218. The discharge arc tube member 21, the thin tube members 211, and 218 are hermetically fit to each other by shrink fit.

The discharge arc tube member 21 includes a main tube part 215 that is in a cylindrical form. One end of the main tube part 215 leads to a taper part 214. Here, one opening of the taper part 214 coincides with one opening of the main tube part 215. And the other opening of the taper part 214 coincides with one opening of a discharge arc tube-end part 212. The taper part 214 is substantially in a shape of a truncated cone, which has an opening at the top and bottom parts.

Just as the taper part 214, the other end of the main tube part 215 leads to a taper part 216, and one opening of the taper part 216 coincides with the other opening of the main tube part 215 different from the one opening coinciding with the taper part 214. Moreover, the other opening of the taper part 216 leads to an opening of the discharge arc tube-end part 207. The taper part 216, as a whole, is shaped substantially as a truncated cone that has an opening at the top and bottom parts.

A discharge arc tube-end part 212 is in a cylindrical form, with an inside diameter being substantially equal to the outside diameter of the fine arc tube member 211. In the same manner, the discharge arc tube-end part 207 is in a cylindrical form, having an inside diameter substantially equal to the outside diameter of the thin tube 218. The main tube part 215, the taper parts 214 and 216, and the discharge arc tube end-parts 207 and 212, as a whole, will be integrally molded, then fired.

As described in the above, the discharge arc tube member 21 has the taper parts 214 and 216, as well as the main tube part 215, three of which situate in the middle portion of the discharge arc tube member 21 and each have an outside diameter that is bigger than the outside diameter of its discharge arc tube-end parts 207 and 212. In addition, the discharge arc tube-end parts 207 and 212 are each fit to the thin tube members 218 and 211 respectively, so as to constitute the arc tube vessel 20 as a whole. Note that the discharge arc tube member 21, the thin tube members 218 and 211 are all in a form of a solid of revolution, so is the arc tube vessel 20.

Inside the discharge space of the arc tube vessel 20, a pair of tungsten electrodes 204 and 217 are arranged to oppose each other, and they constitute the main electrodes. Around one end of the tungsten electrode 204 that outstands in the discharge space, a tungsten coil 205 is wound. Likewise, a tungsten coil 206 is wound around one end of the tungsten electrode 217.

The other end of the tungsten electrode 204 is connected to an end of a feeding member 202. And to the other end of the feeding member 202, an external lead wire 201 is connected. In the same manner, the other end of the tungsten electrode 217 is connected to an end of a feeding member 219, and connected to the other end of the feeding member 219 is an external lead wire 209.

The tungsten electrode 204, the feeding member 202, and the external lead wire 201 are connected to constitute a filament-like member that passes through the thin tube member 211. And the other filament-like member composed of the tungsten electrode 217, the feeding member 219, and the external lead wire 209 which are connected to each other passes through the thin tube member 218. As shown in FIG. 1, the external lead wire 201 is connected to the lead-in wire 103, and the external lead wire 209 is connected to the lead-in wire 106. The arc tube 2 is supplied power through these external lead wires 201 and 209.

The gap formed between the tungsten electrode 204 and the thin tube member 211 is filled with molybdenum coil 203 in such a manner that the molybdenum coil 203 winds around the tungsten electrode 204. Such arrangement of the molybdenum coil 203 prevents the entry of the luminous material into the thin tube member 211. Similarly, the gap formed between the thin tube member 218 and the tungsten electrode 217 is filled with a molybdenum coil 208 in such a manner that the molybdenum coil 208 winds around the tungsten electrode 217, which prevents the entry of the luminous material into the thin tube member 218.

$Dy_2O_3$—$Al_2O_3$—$SiO_2$ frit 210 is filled inside the thin tube member 211 so as to cover the entire feeding member 202. Likewise, $Dy_2O_3$—$Al_2O_3$—$SiO_2$ frit 220 is filled inside the thin tube member 218 so as to cover the entire feeding member 219. The feeding member 202 is hermetically sealed to the thin tube member by the frit 210, and the feeding member 219 is likewise hermetically sealed to the thin tube member by the frit 220. Note that, in the lighting period, the frit 210 helps prevent the feeding member 202 from being eroded by the luminous material. In the same manner, the feeding member 219 is protected through the frit 220 from being eroded by the luminous material.

Enclosed in the discharge space are 5.2 mg of luminous material, a buffer gas (mercury:Hg, about 10.5 mg), and a startup auxiliary rare gas (argon:AR, about 13 kPa). Here, the luminous material is a metal halide that consists of a dysprosium iodide ($DyI_3$, 19 wt %), a thulium iodide ($TmI_3$, 19 wt %), a holmium iodide ($HoI_3$, 19 wt %), a thallium iodide (T1I, 17 wt %), and a sodium iodide (NaI, 26 wt %) and so on.

Figure 3:
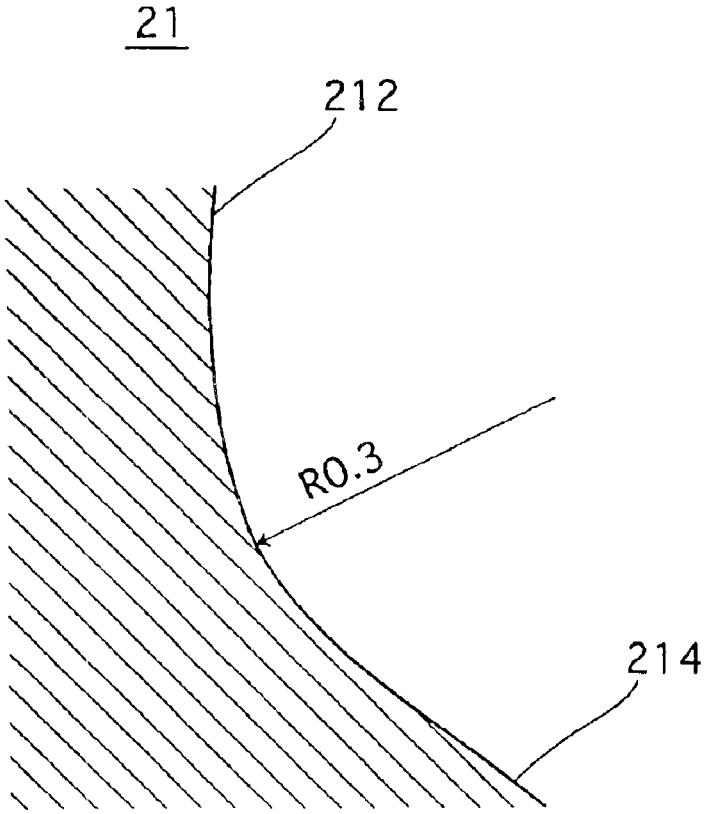
FIG. 3 is a diagram showing an enlarged view of a part of the discharge arc tube member 21 that is surrounded by a broken line 213 of FIG. 2.

FIG. 3 is a diagram showing an enlarged view of a part of the discharge arc tube member 21 that is surrounded by a broken line 213 of FIG. 2. As clear from FIG. 3, the outside surface of the discharge arc tube member 21 continuously changes its angle of inclination as it goes from the taper part 214 to the discharge arc tube-end part 212. The discharge arc tube member 21 is in a shape as a solid of revolution, which makes both FIG. 2 and FIG. 3 a diagram showing the discharge arc tube member 21 that is cut in half at a plane that includes the revolution axis of the discharge arc tube member 21.

The external surface that is from the taper part 214 to the discharge arc tube-end part 212, in its sectional view taken at a plane that includes the revolution axis thereof, (hereinafter referred to as "transitional area") is smoothly curved. Likewise, the external surface from the taper part 216 to the discharge arc tube-end part 207, in the same sectional view, (also referred to as "transitional area") is also smoothly curved.

For the metal halide lamp 1 relating to the present embodiment, a smallest curvature radius is made to be 0.3 mm. The curvature radius is measured along the curve of the transitional areas. Since the discharge arc tube member 21 is shaped as a solid of revolution, the transitional areas each have the smallest curvature all around the transitional areas seen in the mentioned sectional view. That is, the curvature radiuses at all the transitional areas are no smaller than 0.3 mm. In other words, the minimum value of the curvature radius at the transitional areas (hereinafter "minimum curvature radius," being occasionally abbreviated as "R") is 0.3 mm.

Note that the transitional areas of the discharge arc tube member 21 are molded to yield a minimum curvature radius of 0.3 mm. Molded as it is, the occurrence of microcracks is prevented at the firing process. This also helps prevent the arc tube 2 from being broken.

(Material and Size)

The main material and the size of the parts are shown in FIG. 4 relating to the first embodiment.

As shown in FIG. 4, the discharge arc tube member 21, the thin tube members 211 and 218 are made of alumina ceramic. This alumina ceramic is a translucent alumina ceramic obtained from firing a polycrystalline alumina ceramic material which has been molded in a predetermined shape beforehand. Lanthanum (La) or Magnesium (Mg), and the like may be optionally added to this alumina ceramic.

(Test Result)

In the first embodiment, the discharge arc tube member 21 is to have a minimum curvature radius "R" of 0.3 mm at each transitional area. A various arc tubes were created that each have a different minimum curvature radius "R." and quality tests (i.e. aging lighting test) were conducted for the created arc tubes, whose results are shown in the following. Note that the aging lighting tests referred to here means to repeatedly perform a cycle of lighting a metal halide lamp for 5.5 hours and for 0.5 hour that follows turning the light off.

(1) First, a number of 80 metal halide lamps were prepared that have a minimum curvature radius "R" at each transitional area of the discharge arc tube member 21 being in a range of 0.1 mm–1.5 mm, and a number of 20 metal halide lamps that have an arc tube whose angle of inclination for each transitional area of the discharge arc tube member 21 changes discontinuously. In the aging lighting test, the aging lighting hours were set to be 6,000 hours or less for both types of the metal halide lamps, and the voltage from the electricity source was controlled to be 10% larger than the power rating. This means that the electricity consumption by the metal halide lamps is also about 10% larger than normal.

The result of this aging lighting test shows the following. That is, no arc tube was broken for an arc tube which has a minimum curvature radius "R" of 0.3 mm for each transitional area of the discharge arc tube member 21 (total of 70 metal halide lamps). A condition of each transitional area has been examined after the aging lighting test for the 70 metal halide lamps. As a result, no microcrack was found at any transitional area of any lamps among the 70 metal halide lamps examined.

On the other hand, one lamp has been found broken during the aging lighting test among the arc tubes (total of 10 lamps) that have a minimum curvature radius "R" less than 0.3 mm. In addition, two lamps among the 10 lamps were found to have microcracks when observing the condition of the transitional areas, after the aging lighting test.

Among the arc tubes having transitional areas whose angle of inclination changes discontinuously, two lamps were found broken during the aging lighting test. During the observation conducted after the aging lighting test, six out of which were found to have microcracks at the transitional areas. This result suggests that this type of metal halide lamp has a greater chance of having microcracks, than those having a minimum curvature radius "R" being less than 0.3 mm.

To summarize, larger the minimum curvature radius "R" at the transitional areas, the chance of microcracks gets lower at the transitional areas of the arc tube member 21, and the chance of the arc tube being broken gets smaller. In particular, if the minimum curvature radius "R" is made to be larger than 0.3 mm, it will have a remarkable effect of reducing an occurrence of breaking at the transitional areas of the discharge arc tube member 21, and also of reducing the possibility of microcracks.

(2) Next, a number of 100 metal halide lamps were prepared that have an arc tube with a minimum curvature radius "R" at each transitional area being 0.7 mm. And an aging lighting test has been conducted in which 10% more voltage from the source was applied than the power rating for the first 6,000 hours after the aging lighting has started, and after the 6,000 hours has passed and up to 12,000 hours, the voltage from the source was controlled to be the same level as the normal power rating.

The result of the second test shows that the metal halide lamp having "R" of 0.7 mm has an excellent lamp characteristic, as shown in FIG. 5.

(3) Further, each transitional area has been observed as for its angle of inclination being changed discontinuously. This reveals that even before the aging lighting, there are arc tube vessels that have microcracks right after the firing process. This is attributable to the internal stress generated due to the fact that the drop in temperature in the cooling process is not uniform for parts of one vessel.

Once such internal stress is generated, the most vulnerable part of the vessel is the curved areas. This is thought to be why the transitional areas got microcracks. In addition, the thickness of the wall of the discharge arc tube member is normally different for the discharge arc tube-end part and the other parts. This is also thought to contribute to the occurrence of microcracks at the transitional areas.

Further, metal halide lamps having higher wattage will raise its temperature faster in the lighting period, which increases the thermal shock that the arc tube vessel is subject to. In the aging lighting tests, the lighting operation is repeated over and over again. Therefore the thermal shock will be applied to arc tube vessels, every time the metal halide lamps are lit. If there are microcracks at the transitional areas of the discharge arc tube member, the growth of microcracks is accelerated due to the stress imposed on the vessel, the stress being attributable to the thermal shock. These are thought to be the details how the arc tube vessels have been broken in the end.

On the other hand, arc tubes having a minimum curvature radius "R" at each transitional area of the discharge arc tube member being 0.3 mm or larger are examined for the condition at the transitional areas after the firing process For the mentioned type of arc tubes, no microcracks were found, which will not lead to a growth of microcracks in the lighting period. Therefore, the mentioned metal halide lamps having "R" of 0.3 mm or larger yield better resistance against the thermal shock in the lighting period, without depending on the watts, which makes such metal halide lamps hard to break in the end.

Note that there is a method for restricting the occurrence of the microcracks in the firing process. The method is to increase the thickness of the wall of the discharge arc tube member on the whole. However, the increase in thickness for the wall will lead to an increased amount of light and of heat that the arc tube will absorb, which will lead to a reduced luminous efficacy. Therefore, it is not practical to use such a metal halide lamp.

(Second Embodiment)

Figure 6:
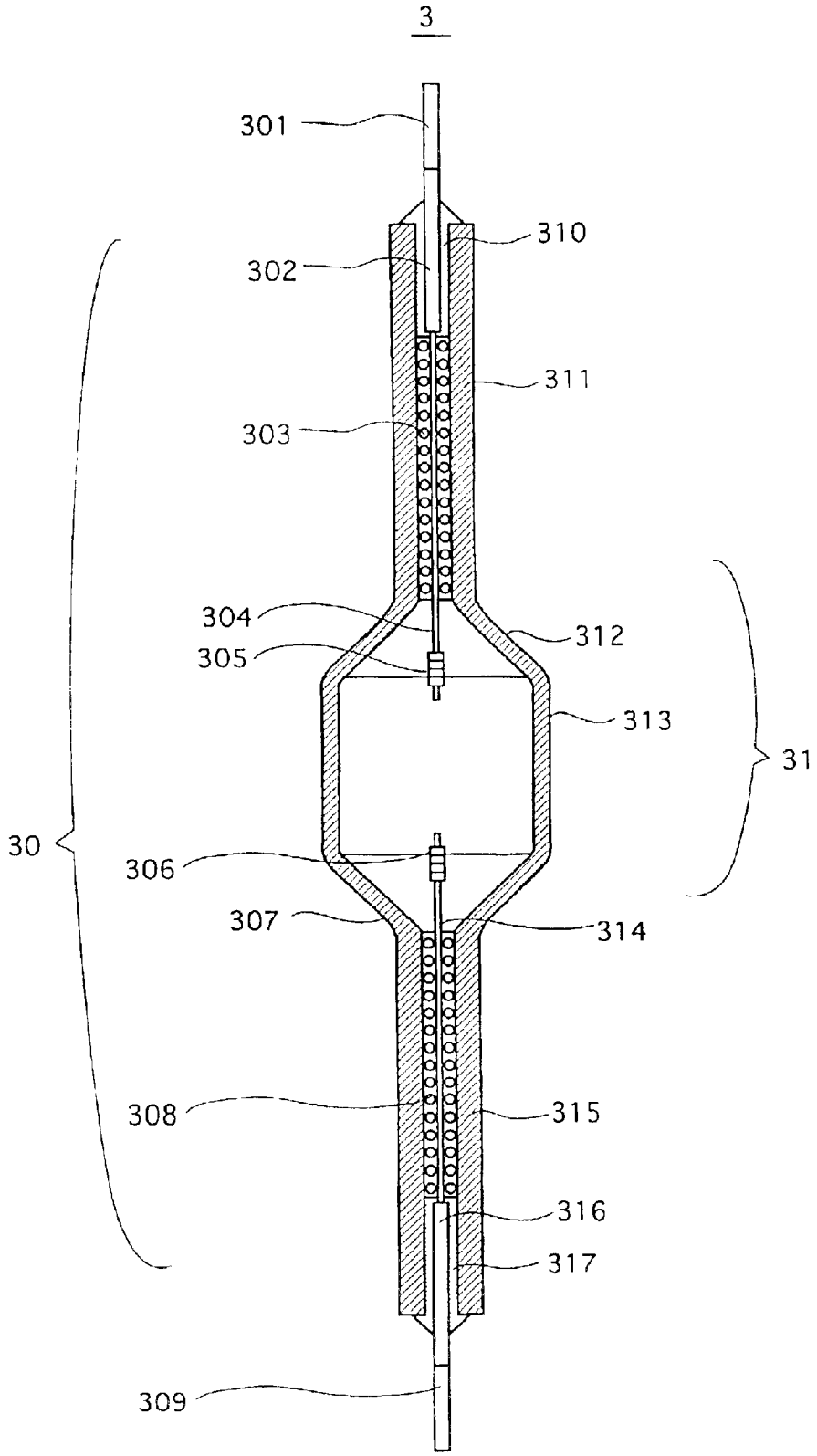
FIG. 6 is a diagram showing a sectional view of the structure of the arc tube 3 for the metal halide lamp relating to the second embodiment, when it is cut in half at a plane including a revolution axis.

FIG. 6 shows a sectional view of a structure of an arc tube for the metal halide lamp relating to the second embodiment. The metal halide lamp in the second embodiment is to be used as an exterior lighting, with its consumption power of 300 W. Note that the lamp may have the same entire structure as shown in FIG. 1, and a different straight-tube structure may also do.

An arc tube 3 in FIG. 6 has a substantially same structure as the arc tube 2 relating to the first embodiment that is shown in FIG. 2. However, the structure of an arc tube vessel 30 is different from the arc tube vessel 20. Specifically, the arc tube vessel 20 has a structure in which both ends of the discharge arc tube member 21 are fit by shrink fit to the thin tube members 211 and 118 respectively, while the arc tube vessel 30 has a structure of molding a discharge arc tube member 31 and thin tube members 311, and 315 in one piece, in which both ends of the discharge arc tube member 31 are integrally-molded to the thin-tube members 311, and 315, respectively.

The discharge arc tube member 31 includes a main tube part 313 in the middle that has a cylindrical form, just as the discharge arc tube member 21 shown in FIG. 2. And one end of the main tube part 313 is connected to a taper part 307, and the other end thereof is connected to a taper part 312, respectively. Here, the taper part 307 is shaped substantially as a truncated cone seen in a side view, with one opening coinciding with an opening of the main tube part 313, and the other opening coinciding with an opening of the thin tube part 315.

The taper part 312 is in a similar shape to the taper part 307, with one opening coinciding with the opening of the main tube part 313, and the other opening coinciding with an opening of the thin tube part 311. Both of the thin tube part 311 that is connected to the taper part 312, and the thin tube part 315 that is connected to the taper part 307 are in a cylindrical shape. The arc tube vessel 30 is formed by firing the discharge arc tube member 31, and the thin tube parts 311 and 315, all of which having been integrally-molded first.

A filament-like member composed of a tungsten electrode 304, a feeding member 302, and an external lead wire 301 passes through the thin tube member 311. Likewise, a filament-like member composed of a tungsten electrode 314, a feeding member 316, and an external lead wire 309 passes through the thin tube member 315.

The end of the tungsten electrode 304 that is not connected with the feeding member 302 has the tungsten coil 305 wound around. Likewise, the end of the tungsten electrode 314 that is not connected with the feeding member 316 has the tungsten coil 306 wound around. The above-mentioned ends of the tungsten electrodes 304 and 314, both having the tungsten coils wound around, are arranged to oppose each other inside the discharge space.

In addition, parts of the tungsten electrode 304 that are surrounded by the thin tube member 311 have a molybdenum coil 303 wound around. Likewise, parts of the tungsten electrode 314 that are covered by the thin tube member 315 have a molybdenum coil 308 wound around. Inside the thin tube member 311 is filled with the $Dy_2O_3$—$Al_2O_3$—$SiO_2$ frit 310 in such a manner that the frit covers the entire feeding member 302.

Inside the thin tube member 315 is likewise filled with $Dy_2O_3$—$Al_2O_3$—$SiO_2$ frit 317, in such a manner that the frit covers the entire feeding member 316. The frit 310 helps to protect the feeding member 302 from being eroded by the luminous material, and the frit 317 protects the feeding member 316 from erosion. The frit 310 and 317 also work to hermetically seal the arc tube vessel 30, and to prevent such material as luminous materials and various gasses from being leaked from the discharge space.

In the first embodiment, a dysprosium iodide: $DyI_3$, a thulium iodide: $TmI_3$, a holmium iodide: $HoI_3$, and the like are enclosed in the discharge space as luminous materials. On the contrary in the second embodiment, a metal halide 16.0 mg mainly composed of a cerium iodide ($CeI_3$), a sodium iodide (NaI), a scandium iodide ($ScI_3$), and a thallium iodide (T1I) are enclosed in the discharge space as luminous materials. Note that also enclosed in the discharge space are a buffer gas (about 52.0 mg of mercury) and a startup auxiliary rare gas (about 13 kPa of argon), which is the same as the arc tube vessel 20 of the first embodiment.

The external surface of the arc tube vessel 30 continuously changes its angle of inclination as it moves from the taper part 307 to the thin tube member 315, just as that of the discharge arc tube member 21 in the first embodiment. Likewise, the angle of inclination continuously changes as it moves from the taper part 312 to the thin tube member 311.

The arc tube vessel 30 is shaped as a solid of revolution. When the arc tube vessel 30 is seen in its sectional view taken at a plane including its revolution axis, the area of the external surface from the taper part 307 to the thin tube member 315 (hereinafter referred to as "transitional area") is smoothly curved, and the minimum curvature radius "R" for the transitional area is 0.3 mm. Likewise, the area of the external surface from the taper part 312 to the thin tube member 311 (also referred to as "transitional area") is smoothly curved, in the same sectional view. And the minimum curvature radius "R" thereof is also 0.3 mm.

In other words, the metal halide lamp 3 relating to the second embodiment has the minimum curvature radius "R" of 0.3 mm at the transitional area.

Note that each transitional area of the arc tube vessel 30 has been molded to yield 0.3 mm of "R" before the firing process. Molded as such, microcracks are prevented, and the breaking of arc tube 2 is also prevented.

(Size)

Materials for the metal halide lamp 3 relating to the second embodiment are the same as the metal halide lamp 1 relating to the first embodiment. FIG. 7 shows sizes of the parts of the metal halide lamp 3.

(Test Result)

The metal halide lamp 3 relating to the second embodiment, which has a power consumption of 300 W and has "R" of 1.0 mm was subjected to an aging lighting test by increasing the source voltage by 10% compared to the normal rating, and by making the aging lighting hours to be 12,000 hours. During the test, no arc tube vessels 30 were found to be broken. After the aging lighting test, each transitional area of the arc tube vessel 30 was examined carefully; no microcracks were found.

Further, metal halide lamps relating to the second embodiment having "R" of 0.3 mm are examined for their qualities under various conditions. For example, metal halide lamps whose power consumptions are in the range of 70 w to 400 w (i.e. the wall-thickness for the arc tube vessel 30 being in the range of about 0.6 mm to 1.3 mm) were examined. No breaking was found for the arc tube vessels 30 during the aging lighting test, and no microcracks occurred at the transitional areas of any arc tube vessels 30 after the test.

Moreover, the metal halide lamp 3 relating to the second embodiment was found to show an excellent characteristic as a lamp, as shown in FIG. 8.

(Relation Between Iodide Sinking)

Generally, metal halide lamps having a ceramic arc tube are known to reduce their lamp efficiency if sinking of iodide occurs. In particular, if their arc tube vessels are integrally molded and the minimum curvature radius "R" at each transitional area is large, the metal halide lamps will have a remarkable sinking of iodide, which makes the lamps not for practical use.

This is because a curvature radius at the internal surface of the wall of the arc tube vessel is a summation of the thickness of the wall and a curvature radius of the external surface corresponding to the internal surface.

If the curvature radius for the external wall of the arc tube vessel is large, the curvature radius for the corresponding internal wall will become large accordingly. This tends to make a gap between the arc tube vessel and the part of the tungsten electrode that is nearer the feeding member.

When the iodide sinks in this gap, the amount of iodide that would contribute to the light emission will decrease, which reduces the lamp efficiency of the metal halide lamp.

In conclusion, an integrally molded arc tube vessel should preferably have its minimum curvature radius "R" being 7 mm or smaller, so that the metal halide lamp will not have any practical problem caused by iodide sinking.

7 mm or smaller "R" is desirable, in light of the maximum possible size of the entire arc tube vessel too. If the minimum curvature radius "R" for the external wall of the arc tube vessel is too large, it becomes hard to make the middle part of the arc tube vessel large enough to have enough capacity inside.

(Modifications)

This invention so far has been explained on the basis of the preferred embodiments; however, needless to say, the embodiments of this invention are not limited to the ones mentioned above. The following describes other possible modifications.

(1) In the above embodiments, polycrystalline alumina ceramic is used as a material for the arc tube vessel. However, the material is not limited to alumina ceramic; if the arc tube vessel is made of ceramic, the present invention may be applied to have effects of restricting the occurrence of microcracks and of preventing the breaking of the arc tube vessel.

(2) In the second embodiment described in the above, the discharge arc tube member of the arc tube vessel is comprised of a tube part and two taper parts that come from the both ends of the tube part. And as shown in FIG. 6, the taper parts are substantially in a shape of a truncated cone. That is, the angles of inclination for the taper parts are described to be substantially the same for every part. However, the angle of inclination for the taper parts may be changed according to the position instead.

For example, the discharge arc tube member may also be formed by making the taper part shaped as a hemisphere that is truncated at the top, and the tube being made to have a same diameter as that of the hemisphere. If conventional arc tube vessel is made in such a way, it has a great possibility of generating microcracks in the firing process, or of breaking in the lighting period. However, if an arc tube vessel is designed to have a minimum curvature radius "R" of 0.3 mm as in the present invention, the arc tube vessel will not have the mentioned problems.

(3) In the above-described embodiments, several examples are listed as for the luminous materials or gasses to be enclosed in the discharge space. However, other luminous materials or gasses may also be enclosed instead. Such material does not have anything to do with the cause of microcracks in the firing process. It is rare that luminous materials or gasses will affect the ceramic material used for the arc tube vessel of the metal halide lamps. Further, the main reason for the break of the arc tube vessel is the thermal shock at the time of lighting.

(4) In the above embodiments, several examples are listed as for the sizes of an arc tube vessel or other constituents. However, the present invention is not limited to such examples, and other sizes may have the equal effect.

Although the present invention has been fully described by way of examples with reference to the accompanying drawings, it is to be noted that various changes and modifications will be apparent to those skilled in the art.

Therefore, unless otherwise such changes and modifications depart from the scope of the present invention, they should be construed as being included therein.

What is claimed is:

1. A metal halide lamp comprising a ceramic arc tube vessel which includes a central tube member and two thin tube members, the central tube member having a larger outside diameter in a middle part than in two ends in a longitudinal direction, and one of the thin tube members being inserted to one of the two ends, and the other thin tube member being inserted to the other end, wherein the central tube member, on an external surface, has two transitional areas each of which has a minimum curvature radius of 0.3 mm to 1.5 mm inclusive, each transitional area being between the middle part and a corresponding one of the ends.

2. The metal halide lamp of claim 1, wherein a power consumption of the metal halide lamp is in a range of 70 W to 400 W inclusive.

3. The metal halide lamp of claim 1, wherein the arc tube vessel is made of alumina ceramic.

4. A metal halide lamp comprising an arc tube vessel made of ceramic, the arc tube vessel having a larger outside diameter in a middle part than in two ends to a longitudinal direction, wherein the arc tube vessel, on an external surface has two transitional areas each of which have a minimum curvature radius of 0.3 mm to 1.5 mm inclusive, each transitional area being between the middle part and a corresponding part one of the ends.

5. The metal halide lamp of claim 4, wherein a power consumption of the metal halide lamp is in a range of 70 W to 400 W inclusive.

6. The metal halide lamp of claim 4, the arc tube vessel is made of alumina ceramic.

7. A metal halide lamp comprising a ceramic arc tube vessel that includes a central tube member and two thin tube members, one of the thin tube members being inserted to one of two ends of the central tube member, and the other thin tube member being inserted to the other end, wherein, the central tube member is made by integrally-molding thereon the two ends thereof which each have a cylindrical-shape, a central part which has a larger diameter than a diameter of the two ends, and two taper parts which are each shaped substantially as a truncated cone, one of the taper parts connecting one of the two ends to a corresponding one of two end portions of the central part, and the other taper part connecting the other end to the other end portion of the central part, and the central tube member, on an external surface, has two transitional areas each of which has a minimum curvature radius of 0.3 mm to 1.5 mm inclusive, each transitional area being between one of the ends of the central tube member and a corresponding taper part.

8. The metal halide lamp of claim 7, wherein a power consumption of the metal halide lamp is in a range of 70 W to 400 W inclusive.

9. The metal halide lamp of claim 7, wherein the arc tube vessel is made of alumina ceramic.

10. A metal halide lamp comprising an arc tube vessel made of ceramic, the arc tube vessel is formed by, integrally-molding two thin tube parts each of which is in a cylindrical shape, a central part which has a larger diameter than the thin tube parts, and two taper parts which are each shaped substantially as a truncated cone, one of the taper parts connecting one of the thin tube parts with one of two ends of the central part and the other taper part connecting the other thin tube part with the other end of the central part, wherein the arc tube vessel, on an external surface, has two transitional areas, each of which has a minimum curvature radius of 0.3 mm to 1.5 mm inclusive, each transitional area being between one of the thin tube parts and a corresponding taper part.

11. The metal halide lamp of claim 10, wherein a power consumption of the metal halide lamp is in a range of 70 W to 400 W inclusive.

12. The metal halide lamp of claim 10, the arc tube vessel is made of alumina ceramic.

* * * * *